US012089754B2

(12) United States Patent
Franson et al.

(10) Patent No.: US 12,089,754 B2
(45) Date of Patent: Sep. 17, 2024

(54) SHIELD FOR DISPLAY CASE GLASS

(71) Applicant: Impact Security LLC, Marietta, GA (US)

(72) Inventors: Jeffrey Franson, Marietta, GA (US); Mark Mineer, Rome, GA (US)

(73) Assignee: Impact Security LLC, Marietta, GA (US)

( * ) Notice: Subject to any disclaimer, the term of this patent is extended or adjusted under 35 U.S.C. 154(b) by 78 days.

(21) Appl. No.: 17/939,814

(22) Filed: Sep. 7, 2022

(65) Prior Publication Data

US 2024/0074599 A1 Mar. 7, 2024

(51) Int. Cl.
*A47F 3/00* (2006.01)

(52) U.S. Cl.
CPC ..... *A47F 3/002* (2013.01); *A47F 3/005* (2013.01)

(58) Field of Classification Search
CPC ..... A47F 3/002; A47F 3/005
USPC ..... 312/137, 140.4; 109/49.5; 248/220.1
See application file for complete search history.

(56) References Cited

U.S. PATENT DOCUMENTS 1,984,138 A * 12/1934 Kennedy ..... A47F 3/12 312/118
4,128,285 A * 12/1978 Lore ..... A47B 37/00 312/196
4,674,394 A * 6/1987 Martino ..... F41H 5/08 2/2.5
4,804,877 A * 2/1989 Harwood ..... A47F 3/002 312/258
4,929,862 A 5/1990 Hamilton et al.
4,973,109 A * 11/1990 Diedrich ..... G07F 9/10 312/265.6
5,390,998 A * 2/1995 Friedman ..... A47F 3/001 312/140.4
5,622,121 A 4/1997 Holler
5,655,462 A 8/1997 Holler
5,853,235 A 12/1998 Barnes
6,375,284 B1 * 4/2002 Frank ..... A47F 3/005 312/257.1
6,375,286 B1 4/2002 Miller et al.
6,378,962 B1 * 4/2002 Green ..... A47F 3/005 312/196
7,712,848 B1 * 5/2010 Frost-Mckinley ..... A47B 67/04 312/240
7,905,560 B2 3/2011 Vardaro et al.
9,615,676 B2 4/2017 Clark et al.
2002/0104839 A1 * 8/2002 Hsiao ..... A47F 3/005 220/4.28

(Continued)

*Primary Examiner* — James O Hansen
(74) *Attorney, Agent, or Firm* — Bryan W. Bockhop; Bockhop Intellectual Property Law, LLC

(57) ABSTRACT

A display case shield for protecting a display case having a frame that supports a first glazing and a second glazing that is transverse to the first glazing includes smash-resistant plastic sheet is bent to include at least one angle between a first portion that covers the first glazing and a second portion that covers the second glazing. An anchoring system secures the smash-resistant plastic sheet to the display case. In a method of protecting a display case, a linear notch is cut in a selected surface of a polycarbonate sheet so as to separate a first portion and a second portion. The polycarbonate sheet is cold bended along the linear notch. The polycarbonate sheet is secured to the display case after the cold bending step.

17 Claims, 3 Drawing Sheets

(56) References Cited

U.S. PATENT DOCUMENTS

2003/0193275 A1 10/2003 Canedy et al.
2019/0090659 A1* 3/2019 Fixler ..... A47F 3/001

* cited by examiner

SHIELD FOR DISPLAY CASE GLASS

BACKGROUND OF THE INVENTION

1. Field of the Invention

The present invention relates to glazing protections systems and, more specifically, to a glazing protections system that protects display case glass.

2. Description of the Related Art

Display cases are typically used to display expensive items, such as jewelry, in retail stores. As shown in FIG. 1, a display case 10 typically includes a metal frame 12 that holds a top sheet 22 of glass and a front sheet 24 of glass that allows viewing of the items for sale, but prevents individuals in the store from accessing the items. The metal frame 12 includes a first face 52, a second face 54, a third face 56 and a fourth face 58.

Since glass can be brittle, dropping heavy objects on the glass can cause it to shatter. Also, "smash-and-grab" robberies have become more frequent in recent years. In such a robbery, a perpetrator will shatter one of the glass sheets with a hammer or other such object and then will reach in the display case to remove the items inside.

Attempts have been made to cover display cases with transparent sheets of plastic to protect the glass. However, common plastics, such as acrylic sheets tend to scratch easily and give the display a cheaper look, which makes items such as jewelry look less desirable to potential consumers. Smash resistant window films have also been tried. While the decrease the likelihood of a glass sheet shattering, they give only limited protection and can be easily cut away with a sharp instrument.

Therefore, there is a need for a display case protection system that appears like glass, but that resists shattering even when hit with objects like sledge hammers.

SUMMARY OF THE INVENTION

The disadvantages of the prior art are overcome by the present invention which, in one aspect, is a display case shield for protecting a display case having a frame that supports a first glazing and a second glazing that is transverse to the first glazing. A smash-resistant plastic sheet is bent to include at least one angle between a first portion that covers the first glazing and a second portion that covers the second glazing. An anchoring system secures the smash-resistant plastic sheet to the display case.

In another aspect, the invention is a display shield for protecting a display case having a frame that supports a first glazing and a second glazing that is transverse to the first glazing. A polycarbonate smash-resistant plastic sheet is bent to include at least one angle between a first portion that covers the first glazing and a second portion that covers the second glazing. The polycarbonate smash-resistant plastic sheet defines a linear notch separating the first portion from the second portion. A first anchor secures a first end of the polycarbonate smash-resistant plastic sheet to the display case. The first anchor includes a first L-shaped strip having a first surface disposed along the first end of the polycarbonate smash-resistant plastic sheet and a second surface disposed along a first edge of the frame; a first fastener that fastens the first surface of the L-shaped strip and the first end of the polycarbonate smash-resistant plastic sheet to a first face of the frame; and a second fastener that fastens the second surface of the L-shaped strip to a second face of the frame. A second anchor secures a second end, disposed oppositely from the first end, of the polycarbonate smash-resistant plastic sheet to the display case. The second anchor includes a second L-shaped strip having a third surface disposed along the second end of the polycarbonate smash-resistant plastic sheet and a fourth surface disposed along a second edge of the frame; a third fastener that fastens the third surface of the L-shaped strip and the second end of the polycarbonate smash-resistant plastic sheet to a third face of the frame; and a fourth fastener that fastens the fourth surface of the L-shaped strip to a fourth face of the frame. A first strip of very high bond tape is adhered to both the first surface of the L-shaped strip and to the polycarbonate smash-resistant plastic sheet. A second strip of very high bond tape is adhered to both the second surface of the L-shaped strip and to the frame.

In yet another aspect, the invention is a method of protecting a display case having a frame that supports a first glazing and a second glazing that is at an angular relationship to the first glazing, in which a linear notch is cut in a selected surface of a polycarbonate sheet so as to separate a first portion that corresponds in size to the first glazing and a second portion that corresponds in size to the second glazing. The polycarbonate sheet is cold bended along the linear notch so that the first portion is at an angular relationship that corresponds to the angular relationship between the first glazing and the second glazing. The polycarbonate sheet is secured to the display case after the cold bending step.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
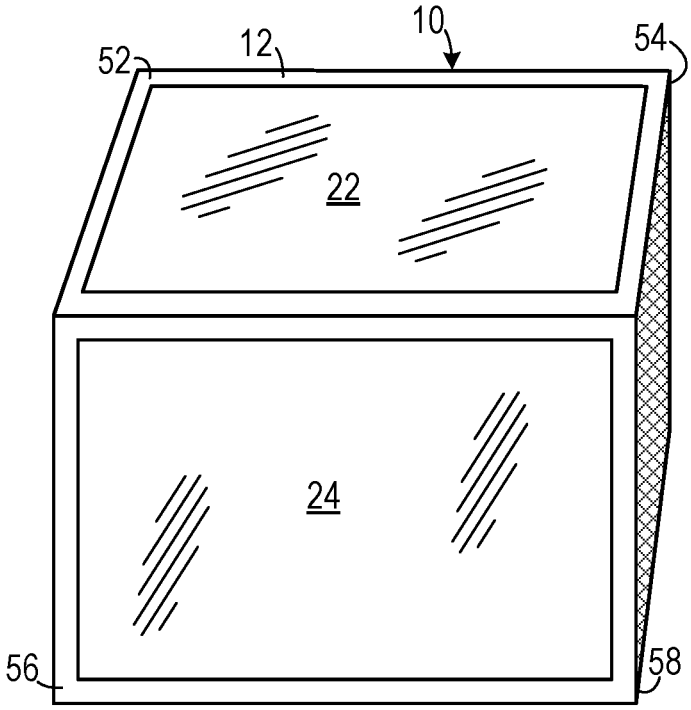
PRIOR ART FIG. 1
FIG. 1 is a top front perspective view of a prior art display case.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 2:
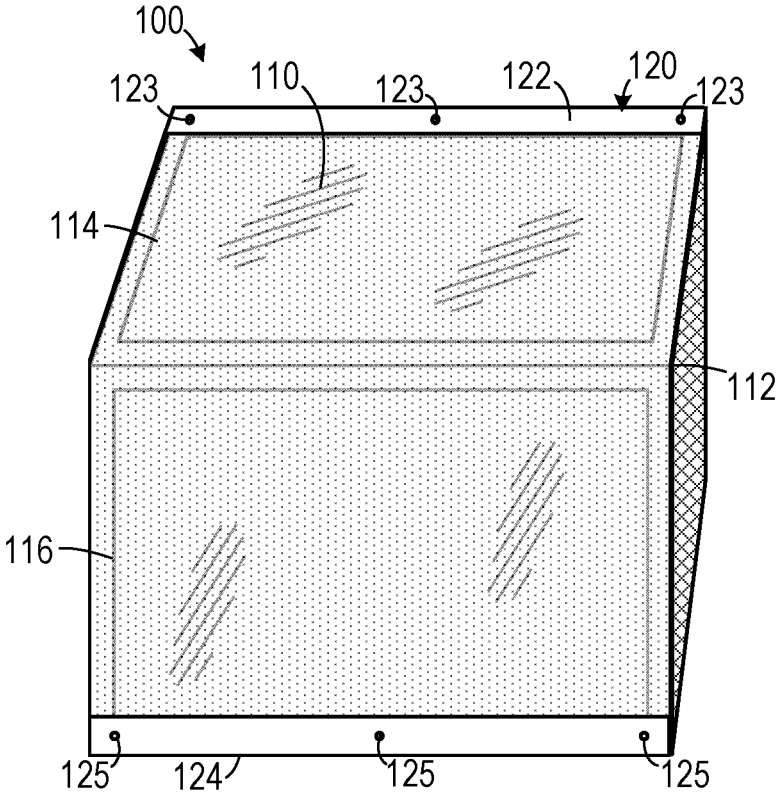
FIG. 2 is a top front perspective view of one embodiment of a display case shield mounted on a display case.

As shown in FIG. 2, one embodiment of a shield 100 for protecting a display case 10 includes a smash-resistant plastic sheet 110 (such as a polycarbonate sheet, which in one embodiment is at least 0.375 inches thick) bent to include at least one angle 112 between a first portion 114 that covers the first glazing 22 and a second portion 116 that covers the second glazing 24. An anchoring system 120 secures the smash-resistant plastic sheet to frame 12 of the display case 10.

Figure 3A:
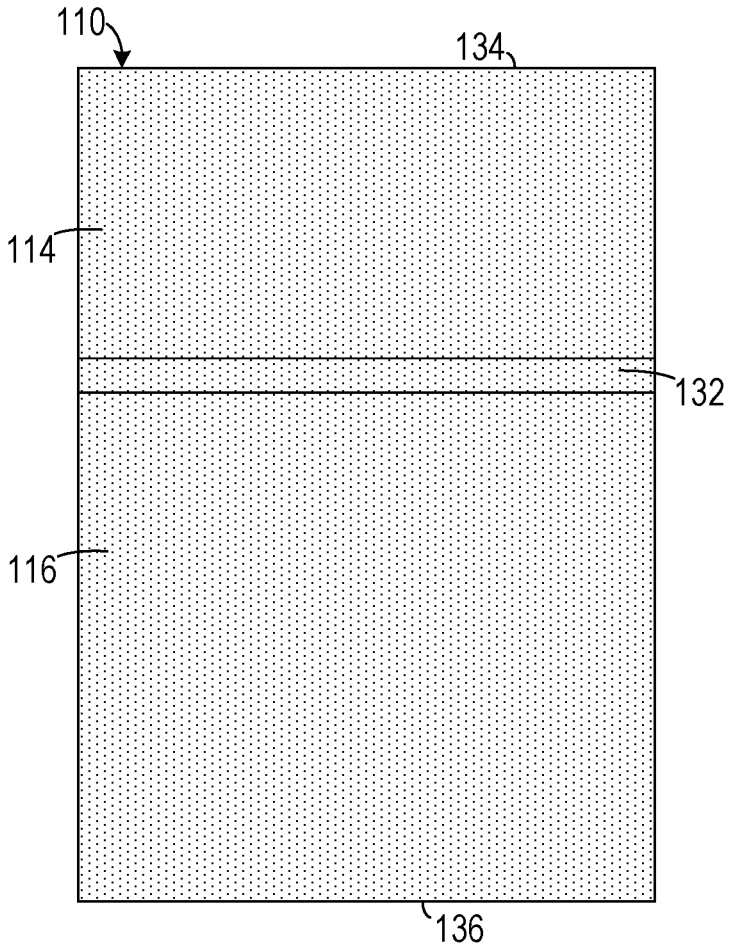
FIG. 3A is a plan view of a smash-resistant plastic sheet for use in a display case shield.
Figure 3B:
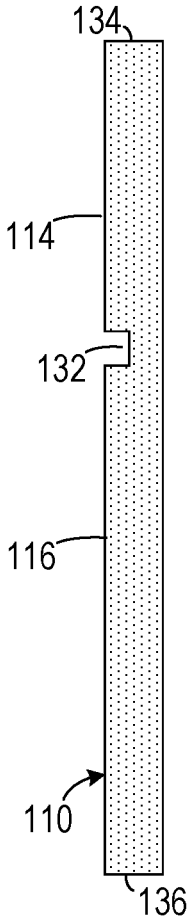
FIG. 3B is a side view of the smash-resistant plastic sheet shown in FIG. 3A.
Figure 3C:
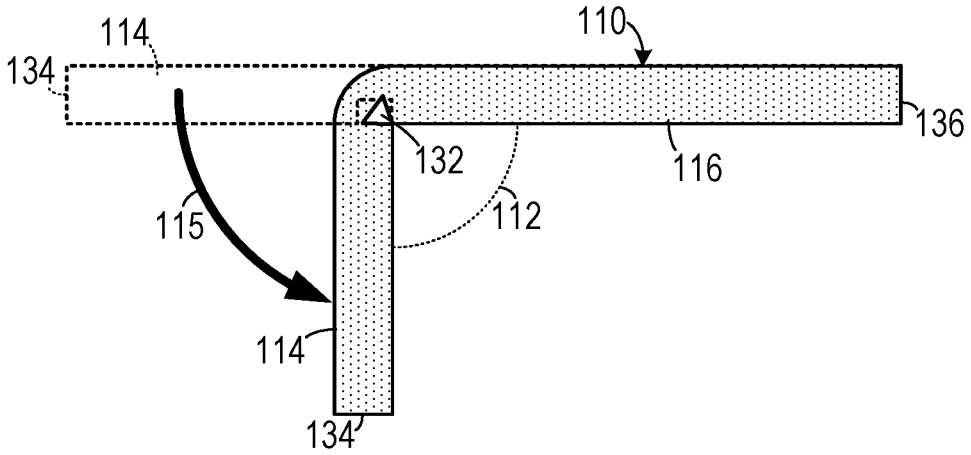
FIG. 3C is a schematic diagram showing the smash-resistant plastic sheet being bent.

Generally, heating a polycarbonate sheet to facilitate bending it will result in discoloration and distortion. Therefore, to ensure that the smash-resistant plastic sheet 110 is clear, it is bent using a cold bending process. As shown in FIGS. 3A-3C, this is done by first cutting (e.g., with a router, a milling machine or one of the known devices for cutting grooves in sheet material) an elongated linear notch 132 that runs linearly along the desired location of the angle 112 separating the first portion 114 and the second portion 116 of the plastic sheet 110. In one embodiment in which the smash-resistant plastic sheet 110 is a 0.375" polycarbonate sheet, the notch 132 can be cut to about 0.125"×0.125". Then a bending force 115 is applied to at least one of the first portion 114 and the second portion 116 to cause the bending in the desired direction so that the plastic sheet 110 bends along the notch 132. In one embodiment, the bending force 115 has a magnitude of at least 30,000 pounds. The notch 132 acts as a compression joint that results in a clean and smooth bend of the plastic sheet 110.

Figure 4:
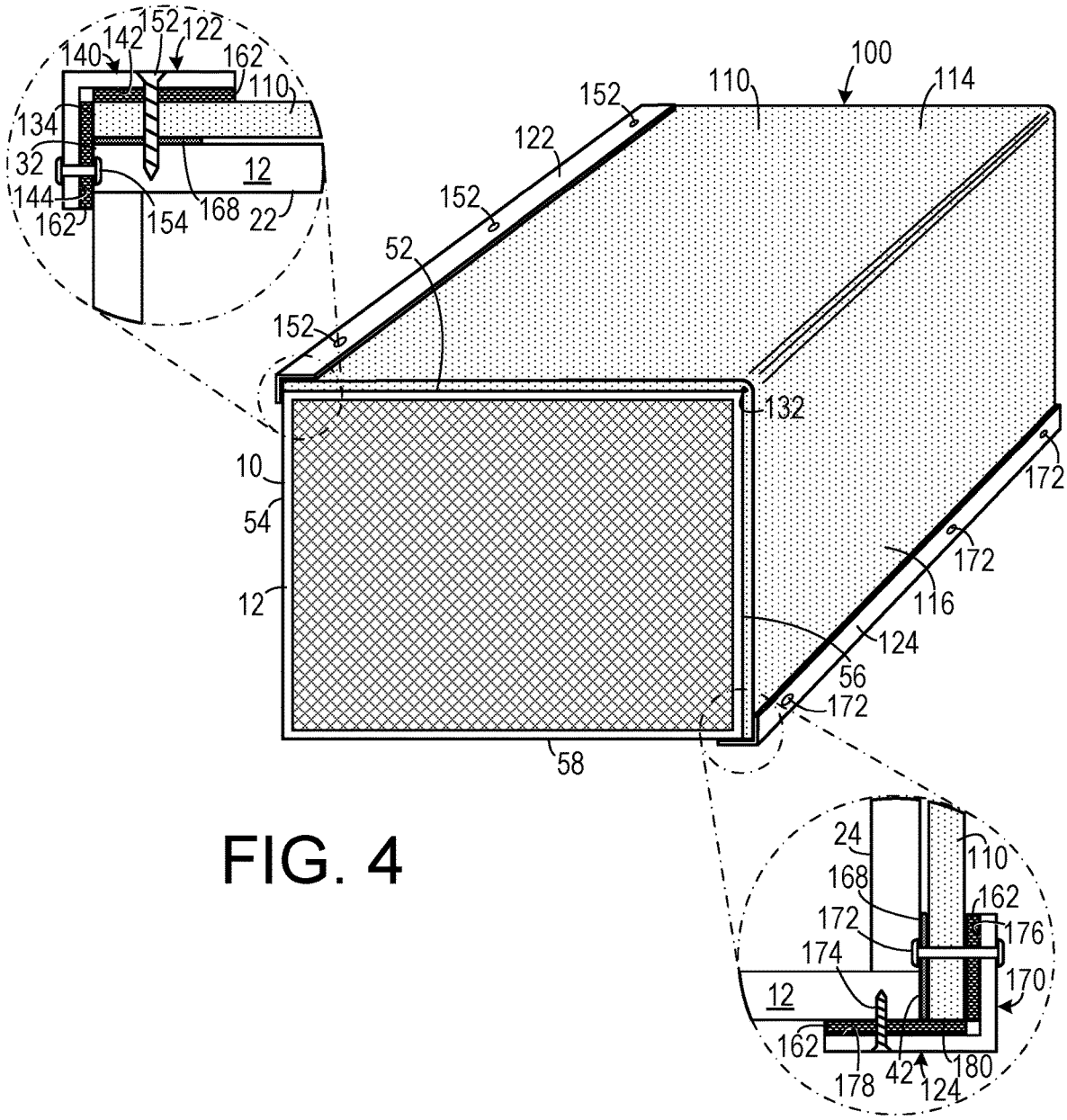
FIG. 4 is a perspective view of the display case and shield therefore.

One embodiment of the anchoring system, as shown in FIG. 4, employs a first anchor 122 that secures a first end 134 of the smash-resistant plastic sheet 110 to the display case 10 and a second anchor 124 that secures a second end 136 to the display case 10. The first anchor 122 includes a first L-shaped strip 140 having a first surface 142 disposed along the first end 134 of the smash-resistant plastic sheet 110 and a second surface 144 disposed along a first edge 32 of the frame 12. A first fastener 152 (which, for example, could be a screw or a rivet—a screw being shown in this example) fastens the first surface of the L-shaped strip 140 and the first end 134 of the smash-resistant plastic sheet 110 to a first face 52 of the frame 12. A second fastener 154 (which, for example, could be a screw or a rivet—a rivet being shown in this example) fastens the second surface 144 of the L-shaped strip 122 to a second face 54 of the frame. Similarly, the second anchor 124 includes a second L-shaped strip 170 having a third surface 176 disposed along the second end 180 of the smash-resistant plastic sheet 110 and a fourth surface 178 disposed along a second edge 42 of the frame 12. A third fastener 172 fastens the third surface 176 of the L-shaped strip 170 and the second end 180 of the smash-resistant plastic sheet 110 to a third face 56 of the frame 12. A fourth fastener 174 fastens the fourth surface 178 of the L-shaped strip 170 to a fourth face 58 of the frame 12.

A first strip of two-sided very high bond tape 162 can be adhered to both the first surface 142 of the first L-shaped strip 140 and to the smash-resistant plastic sheet 110 and a second strip of very high bond tape 162 can be adhered to both the second surface 144 of the L-shaped strip 140 and to the frame 12. Similarly, a third strip of very high bond tape 162 can be adhered to both the third surface 176 of the second L-shaped strip 170 and to the smash-resistant plastic sheet 110 and a fourth strip of very high bond tape 162 can be adhered to both the fourth surface of the L-shaped strip 170 and to the frame 12. Also, a first impact equalization bond material 168 can be placed under the first anchor 122 between a first portion of the smash-resistant plastic sheet 110 and the first glazing 22 and a second impact equalization bond material 168 can be placed under the second anchor 124 and between a second portion of the smash-resistant plastic sheet 110 and the second glazing 24.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above-described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A display case shield for protecting a display case having a frame that supports a first glazing and a second glazing that is transverse to the first glazing, comprising:

(a) a smash-resistant plastic sheet bent to include at least one angle between a first portion that covers the first glazing and a second portion that covers the second glazing; and (b) an anchoring system that secures the smash-resistant plastic sheet to the display case, wherein the anchoring system includes:

a first anchor that secures a first end of the smash-resistant plastic sheet to the display case; and a second anchor that secures a second end, disposed oppositely from the first end, of the smash-resistant plastic sheet to the display case, wherein the first anchor comprises:

a first L-shaped strip having a first surface disposed along the first end of the smash-resistant plastic sheet and a second surface disposed along a first edge of the frame;

a first fastener that fastens the first surface of the L-shaped strip and the first end of the smash-resistant plastic sheet to a first face of the frame; and a second fastener that fastens the second surface of the L-shaped strip to a second face of the frame; and wherein the second anchor comprises:

a second L-shaped strip having a third surface disposed along the second end of the smash-resistant plastic sheet and a fourth surface disposed along a second edge of the frame;

a third fastener that fastens the third surface of the L-shaped strip and the second end of the smash-resistant plastic sheet to a third face of the frame; and a fourth fastener that fastens the fourth surface of the L-shaped strip to a fourth face of the frame.

2. The display case shield of claim 1, wherein the smash-resistant plastic sheet comprises a polycarbonate sheet.

3. The display case shield of claim 2, wherein the polycarbonate sheet has a thickness of at least 0.375 inches.

4. The display case shield of claim 2, wherein the polycarbonate sheet defines a linear notch that runs linearly along the at least one angle between the first portion and the second portion.

5. The display case shield of claim 1, wherein the first fastener, the second fastener, the third fastener and the fourth fastener each comprise a selected one of a screw or a rivet.

6. The display case shield of claim 1, further comprising:

(a) a first strip of very high bond tape that is adhered to both the first surface of the L-shaped strip and to the smash-resistant plastic sheet;

(b) a second strip of very high bond tape that is adhered to both the second surface of the L-shaped strip and to the frame;

(c) a third strip of very high bond tape that is adhered to both the third surface of the L-shaped strip and to the smash-resistant plastic sheet; and (d) a fourth strip of very high bond tape that is adhered to both the fourth surface of the L-shaped strip and to the frame.

7. The display case shield of claim 1, further comprising:

(a) a first impact equalization bond material disposed under the first anchor and between a first portion of the smash-resistant plastic sheet and the first glazing; and (b) a second impact equalization bond material disposed under the second anchor and between a second portion of the smash-resistant plastic sheet and the second glazing.

8. A display shield for protecting a display case having a frame that supports a first glazing and a second glazing that is transverse to the first glazing, comprising:

(a) a polycarbonate smash-resistant plastic sheet bent to include at least one angle between a first portion that covers the first glazing and a second portion that covers the second glazing, the polycarbonate smash-resistant plastic sheet defining a linear notch separating the first portion from the second portion;

(b) a first anchor that secures a first end of the polycarbonate smash-resistant plastic sheet to the display case, the first anchor including:

(i) a first L-shaped strip having a first surface disposed along the first end of the polycarbonate smash-resistant plastic sheet and a second surface disposed along a first edge of the frame;

(ii) a first fastener that fastens the first surface of the L-shaped strip and the first end of the polycarbonate smash-resistant plastic sheet to a first face of the frame; and (iii) a second fastener that fastens the second surface of the L-shaped strip to a second face of the frame; and (c) a second anchor that secures a second end, disposed oppositely from the first end, of the polycarbonate smash-resistant plastic sheet to the display case, the second anchor including:

(i) a second L-shaped strip having a third surface disposed along the second end of the polycarbonate smash-resistant plastic sheet and a fourth surface disposed along a second edge of the frame;

(ii) a third fastener that fastens the third surface of the L-shaped strip and the second end of the polycarbonate smash-resistant plastic sheet to a third face of the frame; and (iii) a fourth fastener that fastens the fourth surface of the L-shaped strip to a fourth face of the frame;

(d) a first strip of very high bond tape that is adhered to both the first surface of the L-shaped strip and to the polycarbonate smash-resistant plastic sheet; and (e) a second strip of very high bond tape that is adhered to both the second surface of the L-shaped strip and to the frame.

9. The display shield of claim 8, further comprising:

(a) a first impact equalization bond material disposed under the first anchor and between a first portion of the polycarbonate smash-resistant plastic sheet and the first glazing; and (b) a second impact equalization bond material disposed under the second anchor and between a second portion of the polycarbonate smash-resistant plastic sheet and the second glazing.

10. The display shield of claim 8, wherein the first fastener, the second fastener, the third fastener and the fourth fastener each comprise a selected one of a screw or a rivet.

11. The display shield of claim 8, wherein the polycarbonate smash-resistant plastic sheet has a thickness of at least 0.375 inches.

12. A display case shield for protecting a display case having a frame that supports a first glazing and a second glazing that is transverse to the first glazing, comprising:

(a) a smash-resistant plastic sheet bent to include at least one angle between a first portion that covers the first glazing and a second portion that covers the second glazing;

(b) an anchoring system that secures the smash-resistant plastic sheet to the display case, wherein the anchoring system includes:

a first anchor that secures a first end of the smash-resistant plastic sheet to the display case; and a second anchor that secures a second end, disposed oppositely from the first end, of the smash-resistant plastic sheet to the display case, wherein the first anchor comprises:

a first L-shaped strip having a first surface disposed along the first end of the smash-resistant plastic sheet and a second surface disposed along a first edge of the frame;

a first fastener that fastens the first surface of the L-shaped strip and the first end of the smash-resistant plastic sheet to a first face of the frame; and a second fastener that fastens the second surface of the L-shaped strip to a second face of the frame; and wherein the second anchor comprises:

a second L-shaped strip having a third surface disposed along the second end of the smash-resistant plastic sheet and a fourth surface disposed along a second edge of the frame;

a third fastener that fastens the third surface of the L-shaped strip and the second end of the smash-resistant plastic sheet to a third face of the frame; and a fourth fastener that fastens the fourth surface of the L-shaped strip to a fourth face of the frame;

(c) a first strip of very high bond tape that is adhered to both the first surface of the L-shaped strip and to the smash-resistant plastic sheet;

(d) a second strip of very high bond tape that is adhered to both the second surface of the L-shaped strip and to the frame;

(e) a third strip of very high bond tape that is adhered to both the third surface of the L-shaped strip and to the smash-resistant plastic sheet; and (f) a fourth strip of very high bond tape that is adhered to both the fourth surface of the L-shaped strip and to the frame.

13. The display case shield of claim 12, wherein the smash-resistant plastic sheet comprises a polycarbonate sheet.

14. The display case shield of claim 13, wherein the polycarbonate sheet has a thickness of at least 0.375 inches.

15. The display case shield of claim 13, wherein the polycarbonate sheet defines a linear notch that runs linearly along the at least one angle between the first portion and the second portion.

16. The display case shield of claim 12, wherein the first fastener, the second fastener, the third fastener and the fourth fastener each comprise a selected one of a screw or a rivet.

17. The display case shield of claim 12, further comprising:

(a) a first impact equalization bond material disposed under the first anchor and between a first portion of the smash-resistant plastic sheet and the first glazing; and (b) a second impact equalization bond material disposed under the second anchor and between a second portion of the smash-resistant plastic sheet and the second glazing.

* * * * *